US005191928A

United States Patent [19]

Sato et al.

[11] Patent Number: 5,191,928

[45] Date of Patent: Mar. 9, 1993

[54] METHOD FOR CONTINUOUS CASTING OF STEEL AND APPARATUS THEREFOR

[75] Inventors: Toshio Sato; Shunichi Sugiyama; Toshio Ishii; Masayuki Nakada; Takashi Oosako; Kentaro Mori, all of Kawasaki, Japan

[73] Assignee: NKK Corporation, Tokyo, Japan

[21] Appl. No.: 798,506

[22] Filed: Nov. 26, 1991

[30] Foreign Application Priority Data

Nov. 27, 1990 [JP] Japan ..... 2-324601

[51] Int. Cl.[5] ..... B22D 11/06; B22D 27/02

[52] U.S. Cl. ..... 164/466; 164/502; 164/440; 164/428

[58] Field of Search ..... 164/466, 498, 502, 147.1, 164/480, 428, 439, 440, 488, 490

[56] References Cited

U.S. PATENT DOCUMENTS 4,450,892 5/1984 Heinemann et al. .
4,986,339 1/1991 Miyazawa .

FOREIGN PATENT DOCUMENTS 0043987 1/1982 European Pat. Off. .
0353736 2/1990 European Pat. Off. .
1-210154 8/1989 Japan .
1-284469 11/1989 Japan .

OTHER PUBLICATIONS

Patent Abstracts of Japan, vol. 14, No. 58, Feb. 1990, Continuous Casting Method, Sumitomo Metal Ind. Ltd.
Patent Abstracts of Japan, vol. 14, No. 428, Sep. 1990, Method for Continuously Casting Steel, Sumitomo Metal Ind. Ltd.
Patent Abstracts of Japan, vol. 13, No. 519, Nov. 1989, Method for Continuously Casting Strip, Sumitomo Metal Ind. Ltd.

*Primary Examiner*—Kuang Y. Lin
*Attorney, Agent, or Firm*—Frishauf, Holtz, Goodman & Woodward

[57] ABSTRACT

A method for continuous casting of steel comprises the steps of feeding molten steel to cooling device for cooling molten steel by use of feeding device for feeding molten steel; cooling fed molten steel by the cooling device; generating a high-frequency magnetic field near a zone where the feeding device, the cooling device and molten steel contact each other; and converging the high-frequency magnetic field on the zone where the feeding device, the cooling device and molten steel contact each other. Further, an apparatus for continuous casting of steel comprises feeding device for feeding molten steel; cooling device for cooling molten steel fed by the feeding device; generating device for generating a high-frequency magnetic field near a zone where the feeding device, the cooling device and molten steel contact each other; and converging device for converging the magnetic field on the zone where the feeding device, the cooling device and molten steel contact each other.

14 Claims, 5 Drawing Sheets

METHOD FOR CONTINUOUS CASTING OF STEEL AND APPARATUS THEREFOR

BACKGROUND OF THE INVENTION

1. Field of the Invention

The present invention relates to a method for continuous casting of steel wherein molten steel is solidified by cooling means and produced solidified shells are successively withdrawn and an apparatus therefor, and more particularly to a method for continuous casting of steel by the use of cooling means such as a cooled roll, a cooled mold and the like and an apparatus therefor.

2. Description of the Related Art

Various methods for continuous casting of steel using a cooled roll and a cooled mold have been reported. Japanese Patent Application Laid Open No. 284469/89 discloses a method for continuous casting of steel wherein a refractory nozzle and a cooled mold connected to said refractory nozzle are used. In this method, the refractory nozzle is means for feeding molten steel and the mold is cooling means. Japanese Patent Application Laid Open No. 210154/89 discloses a method for continuously manufacturing a steel sheet by solidifying molten steel on a circumferential surface of a rotating cooled roll. In this method, a refractory dam is placed near an end face of said cooled roll to hold molten steel on the surface of said roll, and the refractory dam is means for feeding molten steel, and the cooled roll is means for cooling molten steel.

Problems are generally raised that a solidified shell is generated at a zone where cooling means such as a cooled mold and a cooled roll, means for feeding molten steel such as a refractory nozzle and a refractory dam and molten steel contact each other, which gives rise to a great deterioration of surface properties of a cast product.

It is an object of both the prior art methods in the Japanese Patent Application Laid Open No. 284469/89 and the Japanese Patent Application Laid Open No. 210154/89 not to cause defects in a cast porduct. The prior art methods are methods wherein a solidified shell is not generated at a zone where means for cooling molten steel and means for feeding molten steel and molten steel contact each other.

The method for continuous casting of steel disclosed in the Japanese Patent Application Laid Open No. 284469/89 will now be described with specific reference to FIG. 4. FIG. 4 is a partially sectional view illustrating a zone adjacent to a connecting portion where a refractory nozzle for feeding molten steel to a cooled mold is connected to the cooled mold. A coil 4 is placed near the connecting portion where the refractory nozzle 1 is connected to the cooled mold 2. That is, the coil 4 is positioned inside the refractory nozzle 1 just in front of an inlet port of the cooled mold 2. A high-frequency electric current is flowed through the coil 4, thereby generating a magnetic field. A magnetic pressure is generated on the part of molten steel near by a zone where the refractory nozzle 1, cooled mold 2 and molten steel contact each other by interaction between said magnetic field and said molten steel. Molten steel 5 at said zone is pressed toward inside, whereby a space 7 is formed. A solidified shell 6 is hard to be generated at the zone where the refractory nozzle 1 and the cooled mold 5 and molten steel contact each other due to formation of the space 7. The molten steel 5 begins to be solidified from a position adjacent to the space 7 on the inner surface of the mold 2. There is no surface defect such as a draw mark referred to as a cold shut in a withdrawn billet and the billet with good surface properties can be obtained.

The method disclosed in the Japanese Patent Application Laid Open No. 210154 will now be described with specific reference to FIG. 5. FIG. 5 is a partially sectional view illustrating a zone adjacent to a cooled roll and a refractory dam placed near an end face of said cooled roll. The cooled roll 20 is immersed into molten steel 5. The refractory dam 21 is positioned along both the end faces of said cooled rolls 20 so that the molten steel 5 cannot penetrate between the dam 21 and the side of said roll 20. A coil 4 is positioned outside the refractory dam 21. A high-frequency electric current is flowed through the coil 4 whereby a magnetic pressure is generated. The molten steel 5 at a zone adjacent to the end face of the cooled roll 20 and adjacent to the refractory dam 21 is pressed to the inside, thereby a space 7 is formed. A solidified shell is hard to be generated at the zone adjacent to the end face of the cooled roll 20 and adjacent to the refractory dam 21 due to formation of the space 7, which solves a problem of deterioration of surface properties of a steel sheet. That is, there cannot be a problem that the solidified shells generated at the zone adjacent to the cooled roll 20 and adjacent to the refractory dam 21 stick to each other and is connected to each other, that a connecting portion of the solidified shells is broken by rotation of the cooled roll 20, and that end faces of the steel sheet in the direction of the breadth of the steel sheet are made zigzag by repeated sticking and breaking of the solidified shells.

However, since a magnetic field is only generated by simply flowing an electric current through the coil 4, the magnetic field generated is scattered. Therefore, an effective magnetic pressure cannot be caused to act on the zone where cooling means such as the cooled roll 20 and cooled mold 2 and feeding means such as the refractory nozzle 1, refractory dam 21 and the molten steel 5 contact each other. In order to generate a magnetic pressure strong enough to be able to form a space 7 where there is no molten steel at the zone where the cooling means, feeding means and the molten steel 5 contact each other, a great high-frequency electric current shoud be flowed through the coil 4, which requires a high-frequency power source of large capacity.

SUMMARY OF THE INVENTION

It is an object of the present invention to provide a method for continuous casting of steel wherein a steel cast with good surface properties can be produced without any high-frequency power source of large capacity.

To attain the above-mentioned object, the present invention provides a method for continuous casting of steel comprising the steps of:

feeding molten steel to cooling means for cooling molten steel by use of feeding means for feeding molten steel, said feeding means being followed by said cooling means;

cooling fed molten steel by said cooling means;

generating a high-frequency magnetic field near a zone where said feeding means, said cooling means and molten steel contact each other; and converging said high-frequency magnetic field on the zone where said feeding means, said cooling means and molten steel contact each other.

Further, the present invention provides an apparatus for continuous casting of steel, comprising:

feeding means for feeding molten steel;

cooling means for cooling molten steel fed by said feeding means, said feeding means being followed by said cooling means;

generating means for generating a high-frequency magnetic field near a zone where said feeding means, said cooling means and molten steel contact each other; and converging means for converging the magnetic field on the zone where said feeding means, said cooling means and molten steel contact each other.

The above objects and other objects and advantages of the present invention will become apparent from the following detailed description, taken in conjunction with the appended drawings.

DESCRIPTION OF THE PREFERRED EMBODIMENT

Figure 1:
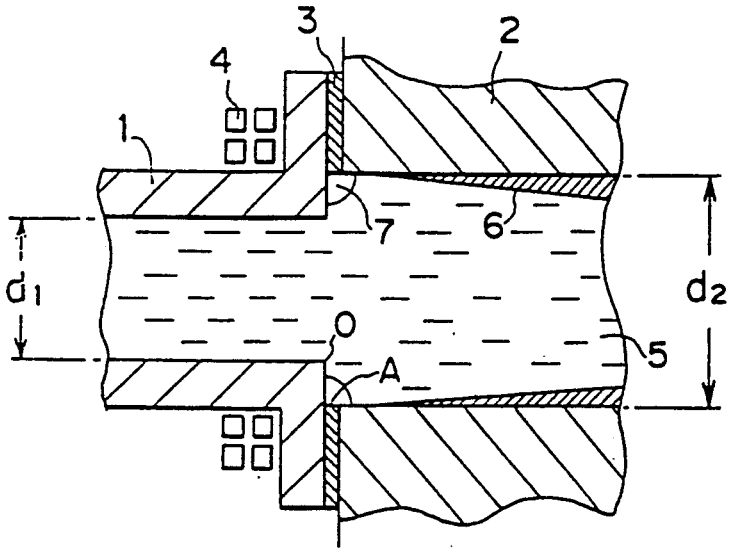
FIG. 1 is a partially sectional view illustrating an apparatus to be used for executing a method for continuous casting of steel according to the present invention.

In the present invention, a high-frequency magnetic field is generated near a zone where feeding means for feeding molten steel, cooling means for cooling molten steel and molten steel contact each other, and the high-frequency magnetic field thus generated is converged on the zone where the feeding means, the cooling means and molten steel contact each other. To converge the high-frequency magnetic field, a magnetic field convergence plate is used. A magnetic pressure generated by the high-frequency magnetic field acts concentratedly on molten steel at the zone where the feeding means, the cooling means and molten steel contact each other.

The magnetic field convergence plate is desired to be made of a soft magnetic material having a high magnetic permeability, a large saturation magnetic flux density and a small hysterisis loss. Silicon steel, pure iron, permalloy and the like are desired as the soft magnetic material.

When a magnetic field is generated near the magnetic field convergence plate, the magnetic field is converged, passing through the magnetic field convergence plate without scattering.

Accordingly, when the magnetic field convergence plate is arranged near the zone of generation of the high-frequency magnetic field on the occasion of generating the high-frequency magnetic field near the zone where the feeding means, the cooling means and molten steel contact each other, the generated high-frequency magnetic field is converged on the magnetic filed convergence plate whereby a high magnetic pressure acts concentratedly on the zone where the feeding means, the cooling means and molten steel contact each other. A space is effectively formed by said concentratedly acting magnetic pressure at the zone where the feeding means, the cooling means and molten steel contact each other, and a solidifeid shell 6 is not generated at said zone.

As described above, the magnetic pressure acts on molten steel at the zone where the feeding means, the cooling means and molten steel contact each other, and the molten steel also is simultaneously heated by an eddy current induced by the magnetic field. The molten steel is heated concentratedly and effectively at the zone where the feeding means, the cooling means and molten steel contact each other, and a solidified shell is prevented from being formed at said zone. Since the magnetic field convergence plate is heated by the eddy curent induced upto a very high temperature and a magnetic property of the magnetic field convergence plate is lowered, the magnetic field is desired to be generated while the magnetic field convergence plate is being cooled.

The high-frequency magnetic field is generated by flowing a high-frequency electric current through a coil. The frequency of the electric current is desired to be from 500 to 10,000 Hz. When the frequency of the electric current is less than 500 Hz, a desired magnetic pressure cannot be obtained. When the frequency of the electric current is over 10,000 Hz, an inputted power is increased and a power loss is increased. The frequency of the electric current is desired to be from 2,000 to 6,000 Hz.

EXAMPLE

Figure 2:
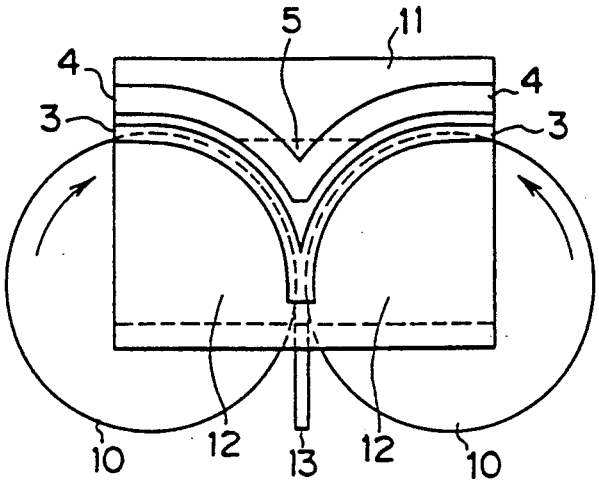
FIG. 2 is a partially sectional view illustrating another apparatus for executing the method for continuous casting of steel according to the present invention.
Figure 2:
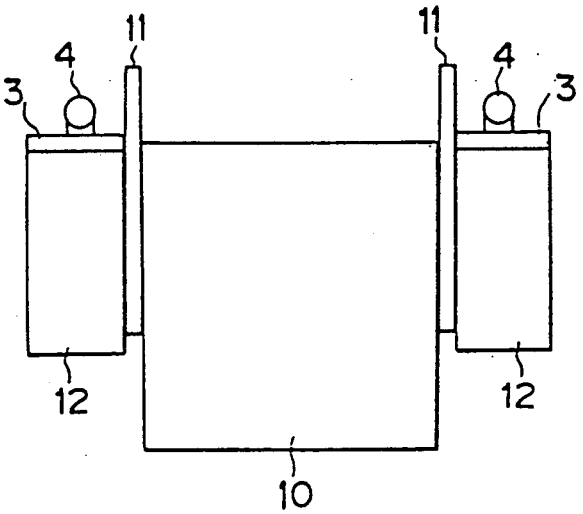

An example of the present invention will now be described with specific reference to the appended drawings. FIGS. 1 and 2 are partially sectional views illustrating apparatuses for executing a method for continuous casting of steel according to the present invention.

FIG. 1 is a partially sectional view illustrating an apparatus for continuous casting of steel wherein a water cooled mold as cooling means for cooling molten steel is connected to a refractory nozzle as feeding means for feeding molten steel. Molten steel in a tundish (not shown) is led to a mold 2 through a refractory nozzle 1. The mold 2 is made of copper and cooled by water. The molten steel 5 led to the mold 2 is cooled, and a solidified shell 6 is formed. A magnetic field convergence plate 3 is placed between the nozzle 1 and the mold 2, both of which are connected to each other via the magnetic field convergence plate 3. A coil 4 is arranged around an outer circumference of the nozzle 1 near the magnetic field convergence plate 3. The magnetic field convergence plate 3 is positioned directly contacting the mold 2 and constantly cooled.

In the method for continuous casting of steel wherein the apparatus as shown in FIG. 1 is used, billets are intermittently or successively withdrawn from the mold 2. When a high-frequency electric current is flowed through the coil 4 during withdrawing of billets, a great magnetic pressure is concentrated on a zone where the nozzle 1, the mold 2 and molten steel 5 contact each other. Even if a great electric current is not flowed, a space 7 is formed at the zone where the nozzle 1, the mold 2 and molten steel 5 contact each other.

Figure 3:
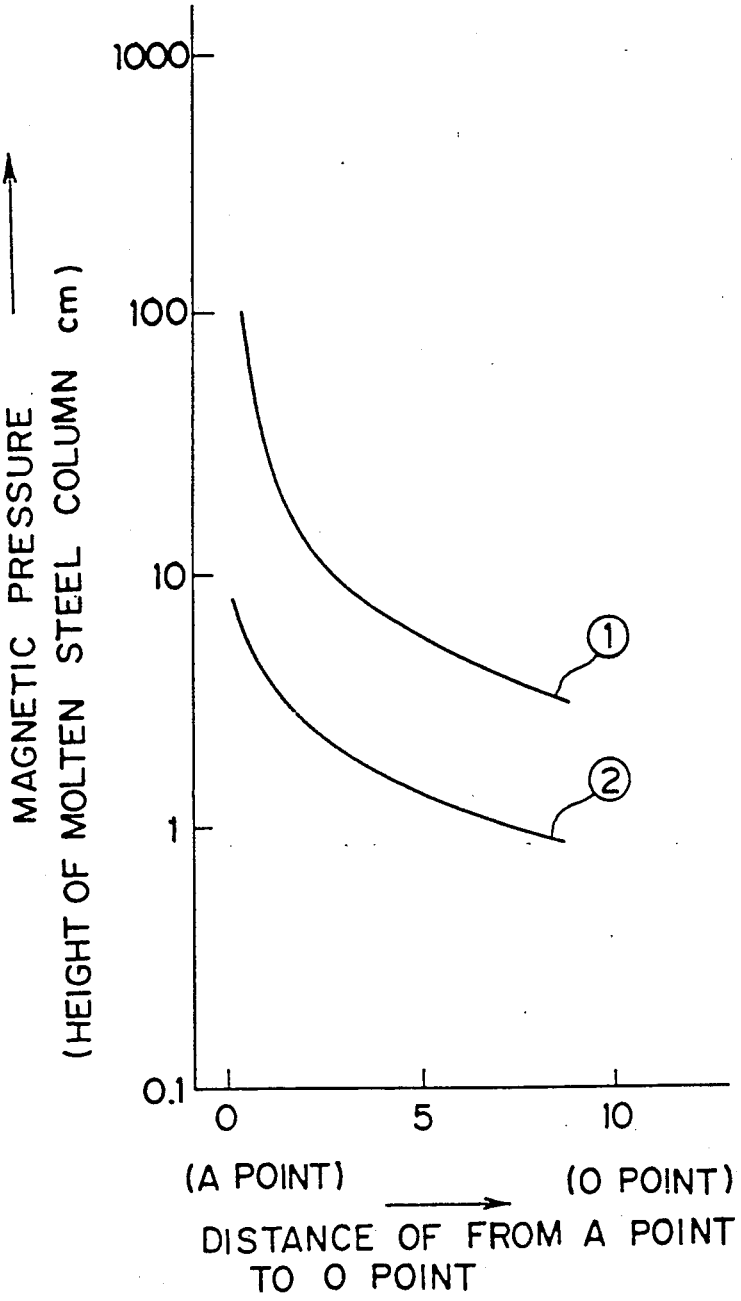
FIG. 3 is a graphical representation showing a magnetic pressure generated at a connecting portion where a refractory nozzle is connected to a mold during casting of a billet according to the present invention.
Figure 4:
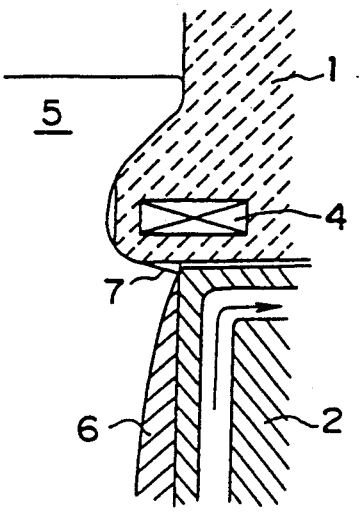
FIG. 4 PRIOR ART
FIG. 4 is an explanatory view of a method for continuous casting of a billet according to the prior art method.
Figure 5:
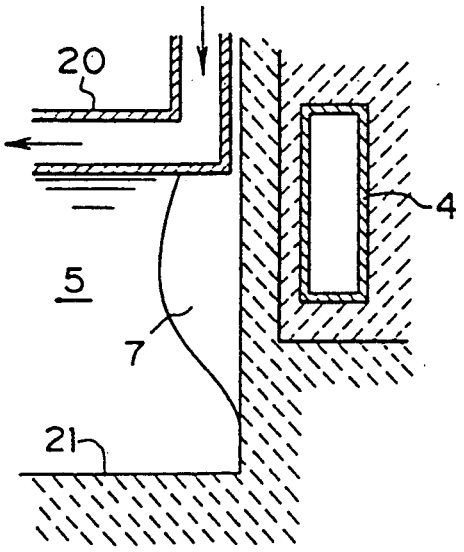
FIG. 5 PRIOR ART
FIG. 5 is an explanatory view of another method for continuous casting of a billet according to the prior art method.

A round billet of 60 mm in diameter was produced using an apparatus as shown in FIG. 1. A magnetic pressure generated at the zone where the nozzle 1, the mold 2 and molten steel 5 contact each other was found by means of a simulation. The result of the simulation is shown in FIG. 3. The production condition is shown in Table 1.

TABLE 1

| | |
|---|---|
| Inside diameter $d_1$ of the refractory nozzle | 40 mm |
| Inside diameter $d_2$ of the mold | 60 mm |
| Material for the magnetic field convergence plate | electrical steel plate |
| Thickness of the magnetic field convergence plate | 1.5 mm |
| Relative magnetic permeability | 100 |
| High-frequency electric current | 3000 A |
| Frequency | 3000 Hz |

The variation of the magnetic pressure of from A point on an end face of the magnetic field convergence plate 3 inside the mold 2 to 0 point at the corner of the nozzle 1 on the side of the mold 2 is shown in FIG. 3. The magnetic pressure is represented in terms of molten steel column height. In FIG. 3, a curve of (1) denotes a variation of the magnetic pressure on condition shown in Table 1, and a curve of (2) denotes a variation of the magnetic pressure in the case where the magnetic field convergence plate 3 is not used and the magnetic field is not converged.

As clearly seen from FIG. 3, the magnetic pressure at the A point was about 10 cm in the case of (2) where the magnetic field was not converged. The magnetic pressure in the case of the example of (1) was about 100 cm in terms of molten steel column. The magnetic pressure at the A point was increased about ten times by converging the magnetic field. The magnetic pressure in the case where the magnetic field was converged at the zone where the nozzle 1 and the mold 2 contact molten steel 5 also is presumed to be increased ten times compared with the case where the magnetic field is not converged.

Casting of steel was carried out by means of a continuous withdrawing for the case where the magnetic field was converged in the example and for the case where the magnetic field was not converged in comparison respectively in accordance with the result of the simulation. As a result, it was confirmed that surface properties of an obtained billet were good and the billet was stably produced in the case where a high-frequency electric current of 2,000 A and 3,000 Hz was flowed in the example, and that the results of the example were better than in the case where a high-frequency electric current of 5,000 A and 3,000 Hz was flowed in the comparison.

Figure 6:
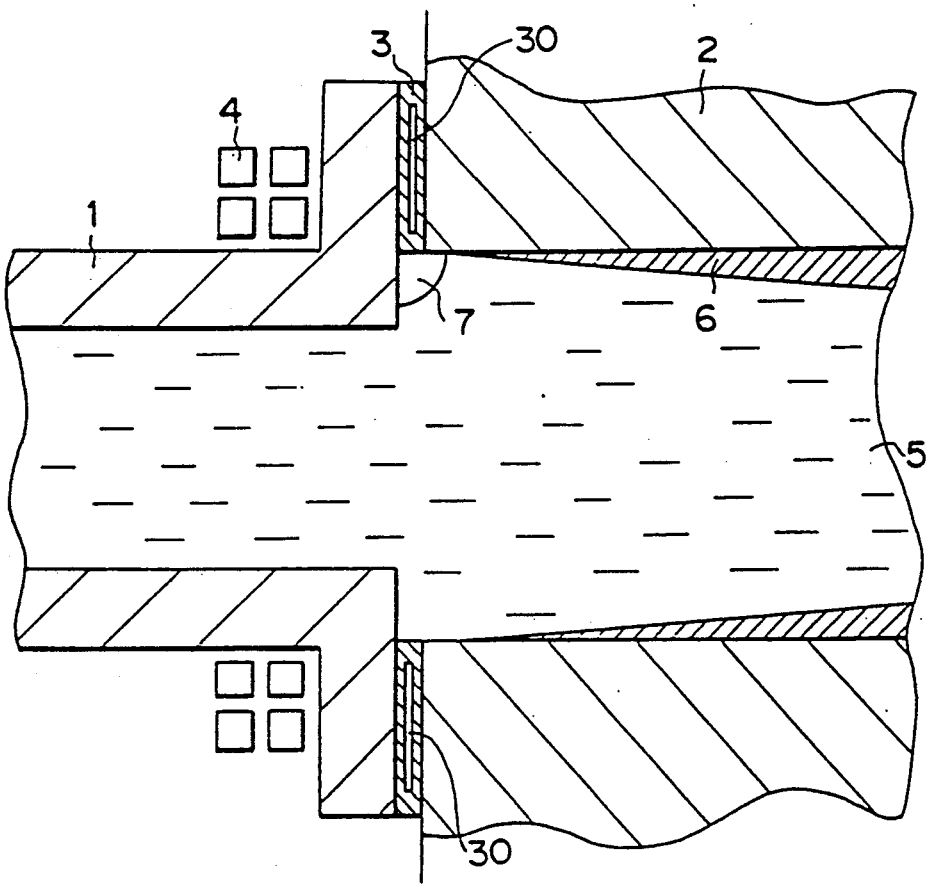
FIG. 6 is a partially sectional view illustrating another apparatus for executing the method for continuous casting of steel according to the present invention.

A cooling water passage 30 is made in the magnetic field convergence plate 3 of the apparatus for continuous casting of steel as shown in FIG. 6. The magnetic field convergence plate 3 is cooled by water flowing in the cooling water passage 30.

FIGS. 2 (A) and (B) are partially sectional views illustrating a top pouring apparatus for continuous casting of a steel sheet having two cooled rolls. FIG. 2 (A) is an elevation of the apparatus. FIG. 2 (B) is a side elevation of the apparatus. Reference numeral 10 denotes cooled rolls which rotate and are positioned in parallel with each other and adjacent to each other, and 11 a refractory dam which forms a basin to store molten steel 5 on the cooled rolls 10, being arranged adjacent to both the ends of the cooled rolls. The magnetic field convergence plate 3 is placed along a circularly arcking zone where the end face of the cooled roll 10, the refractory dam 11 as a connecting refractory and molten steel 5 contact each other. A cooling box 12 is placed directly under this magnetic field convergence plate 3 and connected to this plate 3 as a united body, whereby the plate 3 is cooled constantly. The coil 4 is positioned on the magnetic field convergence plate 3.

The molten steel 5 fed to the basin is cooled by the cooled roll 10 during casting of a steel sheet. A solidified shell is formed around the cooled roll 10. The solidified shell moves successively downwardly with rotation of the cooled roll 10 and converts to a steel sheet 13, being pressed between the cooled rolls 10. On this occasion, a great magnetic pressure acts concentratedly on a circularly arcked zone when a high-frequency electric current is flowed through the coil 4. Consequently, even if a great electric current is not flowed through the coil 4, a space is formed in the aforementioned circularly arcked zone.

Subsequently, a magnetic pressure generated in the aforementioned circularly arcked zone during casting of a steel sheet by the use of an apparatus having the same structure as that in FIG. 2 was found by means of a simulation. According to the result obtained by the simulation, the magnetic pressure in terms of molten steel column was 50 cm in the case of converging the magnetic field (in the example) whereas the magnetic pressure in terms of molten steel column was 5 cm in the case of not converging the magnetic field (in the comparison). The magnetic field was increased ten times by converging the magnetic field. The condition in this case was shown in Table 2.

TABLE 2

| | |
|---|---|
| Material for magnetic field convergence | electric steel |
| Thickness of magnetic field convergence plate | 1.5 mm |
| Relative magnetic permeability of magnetic field convergence plate | 100 |
| High-frequency electric current | 2000 A |
| Frequency | 3000 Hz |

As a result, it was understood that a steel sheet with good surface properties can be manufactured stably even if no great electric current is flowed through the coil 4.

Since the method of the present invention is a method wherein a magnetic pressure is caused to act concentratedly on the zone where the cooling means, the feeding means and molten steel contact each other by generating a high-frequency magnetic field near said zone and by converging the high-frequency magnetic field on the magnetic field convergence plate, any solidified shell cannot be formed at said zone by forming a space where there is no molten steel at said zone, using only a small amount of electric power.

Accordingly, the electric power can be greatly reduced and a cast product with good surface properties can be stably manufactured without causing a high-frequency electric power source to have a large capacity.

What is claimed is:

1. A method for continuous casting of steel, comprising the steps of:

feeding molten steel to cooling means for cooling molten steel by use of feeding means for feeding molten steel, said feeding means being followed by said cooling means;

cooling fed molten steel by said cooling means;

generating a high-frequency magnetic field near a zone where said feeding means, said cooling means and molten steel contact each other; and converging said high-frequency magnetic field on the zone where said feeding means, said cooling means and molten steel contact each other.

2. The method of claim 1, wherein said high-frequency magnetic field is generated by a coil placed near the zone where said feeding means, said cooling means and molten steel contact each other.

3. The method of claim 1, wherein said magnetic field is converged by a magnetic field convergence plate which is made of a soft magnetic material and which has a cooling device.

4. The method of claim 3, wherein said soft magnetic material is one selected from the group consisting of a silicon steel, pure iron and permalloy.

5. The method of claim 1, wherein said feeding means is a refractory nozzle;

said cooling means is a water-cooled mold, molten steel being fed from the nozzle to the mold;

said high-frequency magnetic field is generated by a coil arranged around a circumference of said nozzle; and said magnetic field generated is converged by a magnetic field convergence plate positioned between said nozzle and said mold.

6. The method of claim 1, wherein said cooling means are two rotating cylindrical rolls arranged at intervals, molten steel fed into between said two cylindrical rolls being cooled by said rolls;

said feeding means are refractory dams positioned on both end faces of the cylindrical rolls to store molten steel on the two rolls as the cooling means;

said high-frequency magnetic field is generated by the coil placed near a zone where the refractory dam, the cylindrical rolls and molten steel contact each other; and said magnetic field generated is converged by the magnetic field convergence plate along the zone where the refractory dam, the cylindrical roll and molten steel contact each other.

7. The method of claim 6, wherein said magnetic field convergence plate has a cooling box thereunder.

8. An apparatus for continuous casting of steel, comprising:

feeding means for feeding molten steel;

cooling means for cooling molten steel fed by said feeding means, said feeding means being followd by said cooling means;

generating means for generating a high-frequency magnetic field near a zone where said feeding means, said cooling means and molten steel contact each other; and converging means for converging the magnetic field on the zone where said feeding means, said cooling means and molten steel contact each other.

9. The apparatus of claim 8, wherein said generating means is a coil positioned near the zone where said feeding means, said cooling means and molten steel contact each other.

10. The apparatus of claim 8, wherein said converging means is a magnetic field convergence plate made of a soft magnetic material.

11. The apparatus of claim 10, wherein said soft magnetic material is one selected from the group consisting of a silicon steel, pure iron and permalloy.

12. The apparatus of claim 10, wherein said feeding means is a refractory nozzle;

said cooling means is a water-cooled mold, molten steel being fed from the nozzle to the mold;

said generating means is a coil arranged around a circumference of said nozzle; and said converging means is a magnetic field convergence plate positioned between said nozzle and said mold.

13. The apparatus of claim 10, wherein said cooling means are two rotating cylindrical rolls arranged at intervals, molten steel fed into between said two rolls being cooled by said rolls;

said feeding means are refractory dams positioned on both end faces of the cylindrical rolls to store molten steel on the two cylindrical rolls as said cooling means;

said generating means is a coil placed near a zone where the refractory dam, the cylindrical rolls and molten steel contact each other; and said converging means is a magnetic field convergence plate arranged along the zone where the refractory dam, the cylindrical rolls and molten steel contact each other.

14. The apparatus of claim 10, wherein said magnetic field convergence plate has a cooling box thereunder.

* * * * *